United States Patent [19]

Hahn

[11] 4,437,575

[45] Mar. 20, 1984

[54] COUNTERTOP MINI-GARBAGE CAN

[76] Inventor: Geraldine L. Hahn, 351 189th St., Miami Beach, Fla. 33160

[21] Appl. No.: 464,685

[22] Filed: Feb. 7, 1983

[51] Int. Cl.[3] ..... B65D 25/14

[52] U.S. Cl. ..... 220/1 T; 220/85 H; 220/87; 220/408; 220/410

[58] Field of Search ..... 220/1 T, 85 H, 87, 408, 220/410

[56] References Cited

U.S. PATENT DOCUMENTS

| | | | |
|---|---|---|---|
| 1,656,015 | 1/1928 | Radcliffe | 220/87 |
| 1,872,771 | 8/1936 | Little | 220/85 H |
| 2,147,139 | 2/1939 | Bigman | 220/87 |
| 2,932,423 | 4/1960 | Baumgartner | 220/85 H |
| 3,015,405 | 1/1962 | Sterling | 220/1 T |
| 3,300,083 | 1/1967 | Wright | 220/408 |
| 3,741,434 | 6/1973 | Traverse | 220/1 T |

*Primary Examiner*—George E. Lowrance

[57] ABSTRACT

This invention is a miniature garbage can for placement upon a countertop; and being shaped to contain a replaceable used, paper milk carton, for use as a liner; the can including a hinged cover having a deodorant receptacle.

1 Claim, 4 Drawing Figures

Country Dairy Fresh
MILK
VITAMINS A & D ADDED
ONE QUART

COUNTERTOP MINI-GARBAGE CAN

This invention relates generally to kitchen accessories. More specifically, it relates to refuse receptacles.

It is well known to most homemakers, that, while preparing foods in a kitchen small particles of refuse are frequently needed to be discarded, such as when peeling a vegetable, trimming fat from a meat, or discarding a foil wrapper from a stick of butter. Often this refuse item is too small to warrant the need of reaching down to the under-counter refuse receptacle each time, and therefore, it temporarily accumulates in the sink corner, or is dropped in an empty bag on the counter for disposal afterwards. This can be messy, so that this situation is, accordingly, in need of an improvement.

Therefore, it is a principal object of the present invention to provide a miniature garbage can of pleasing appearance, for placement upon a countertop, and which eliminates the handling of paper bags or cartons, that become soggy from garbage during use.

Another object is to provide a miniature garbage can, which is made to be fitted with a used, empty, conventional paper milk carton for service as a liner, and which is available in most homes; the liner being discarded with its contained garbage when filled up, thus eliminating the soiling of the can and need of frequent washing thereof.

Yet another object is to provide a countertop mini-garbage can, which would prove useful in homes equipped with electrically powered garbage disposal units, and which are always subject to periodic breakdowns, just as other electrical devices in the home.

Other objects are to provide a countertop mini-garbage can, which is simple in design, inexpensive to manufacture, rugged in construction, easy to use, and efficient in operation.

These, and other objects, will be readily evident, upon a study of the following specification, and the accompanying drawing, wherein.

Figures 1, 2, 3, 4:
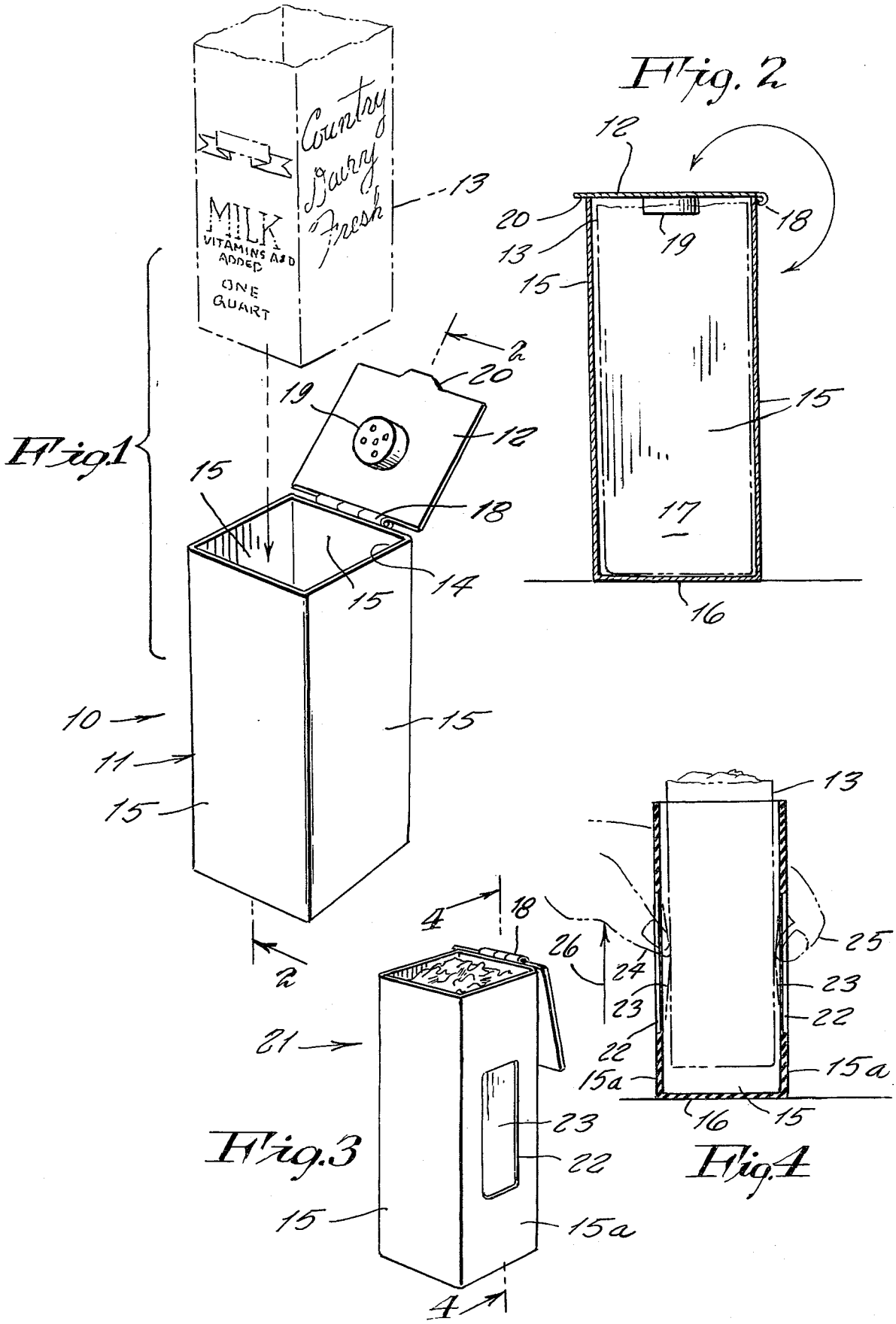
FIG. 1 is a perspective view of one design of the invention, shown with an empty milk carton being inserted therein.
FIG. 2 is a side cross-sectional view thereof, taken on line 2—2 of FIG. 1, and showing the milk carton placed therein.

FIG. 3 is a perspective view of another design of the invention, which includes a thin, stretchable portion at the center of opposite side walls of the device, so that, as shown in FIG. 4 a person can squeeze this portion between the fingers, in order to grasp the carton and lift it a little, so that, if filled with garbage, the upper end of the carton may thus be easily grasped, in order to lift completely out of the can; and FIG. 4 is a side cross-sectional view, taken on line 4—4 of FIG. 3, showing the garbage-filled carton being lifted a bit, so that the carton upper end is out of the can for easy grasp.

Referring now to the drawing in greater detail, and more particularly to FIGS. 1 and 2 thereof, at this time, the reference numeral 10 represents a countertop mini-garbage can, according to the present invention, wherein there is a container 11, that is closable by means of a cover 12. The container of the invention is made in a size and shape so as to be fitted with a used, conventional paper milk carton 13, of either one quart or one-half gallon size, that can be dropped thereinto through a top opening 14 of the container; the container, accordingly, including only four vertical side walls 15, and a bottom wall 16 around a central space 17 receiving the carton. Preferably, the container and its cover 12 are molded from plastic, so as to be inexpensive in manufacture and easy to keep sanitarily clean, and they may be made in any color, so as to suit any decor.

While the container is made suitable for being fitted with a used milk carton, as above described, it is to be noted that this miniature garbage can may possibly be retailed with a packet of thin polyethylene bags, for use as replaceable liners by such persons who do not purchase milk in cartons, and, accordingly, do not have such emptied cartons available.

The cover may be made integrally with the container, by a folded over hinge, or else with a pin hinge 18, as shown in the drawing. A receptacle 19 may be made on an underside of the cover for holding a replaceable deodorant, so as to prevent garbage odors being formed inside the can. A tab 20, protruding on a front edge of the cover, when a person's hands are occupied holding refuse for being discarded.

For operative use, the top of the milk carton is fully opened up, as shown.

In a modified design of countertop mini-garbage can 21, shown in FIGS. 3 and 4, means are provided for lifting a filled, or over-filled, carton out of the container easily and which might be particularly necessary if the carton contains a considerable amount of liquid, so that is is inadvisable to turn it upside down, when being discarded. In this design, a vertically elongated opening 22 is made through a pair of opposite side walls 15*a*, and each of these openings is then sealed by a thin, flexible rubber film or sheet 23, adhered by suitable adhesive all around the edge of the opening on the inner side of the container; the sheet being in a flat condition, and sealing the interior space 17 of the can, so that no interior odors may escape outward therefrom.

In operative use, to raise a filled carton upwardly out of the container, a person's fingers 24 and 25 are placed against the two rubber films, grasping the carton firmly therebetween, and are then moved upward sufficiently so that the carton upper end is lifted out of the container, the films being stretchable in the direction of arrow 26 during this movement.

While various changes may be made in the detail construction, it is understood that such changes will be within the spirit and scope of the present invention, as is defined by the appended claims.

What I claim as new, is:

1. A countertop mini-garbage can, comprising, in combination, a container and a pivoted cover upon a top of said container for selectively closing a top opening of said container, said container comprising four vertically elongated side walls and a horizontal bottom wall, said container being of a size and shape for receiving a conventional paper milk carton, amd means for grasping and upwardly lifting said carton outward of said container, said means comprising a vertically elongated opening made through a pair of opposite said side walls, a thin, stretchable rubber film adhered all around an edge of each said openings for sealing an interior space of said container, and in use being stretchable in a vertical direction; a receptacle on an underside of said cover, said receptacle containing a replaceable deodorant; and said cover having a projecting tab on a front edge thereof.

* * * * *